US007330690B2

(12) United States Patent
Amano et al.

(10) Patent No.: US 7,330,690 B2
(45) Date of Patent: Feb. 12, 2008

(54) IMAGE FORMING APPARATUS, DEVELOPER RECYCLE APPARATUS AND DEVELOPER RECYCLE METHOD

(75) Inventors: Takafumi Amano, Kawasaki (JP); Takashi Ikeda, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/866,693

(22) Filed: Jun. 15, 2004

(65) Prior Publication Data

US 2005/0276640 A1 Dec. 15, 2005

(51) Int. Cl.
*G03G 21/00* (2006.01)

(52) U.S. Cl. ..... 399/359; 399/358

(58) Field of Classification Search ..... 399/359, 399/358

See application file for complete search history.

(56) References Cited

U.S. PATENT DOCUMENTS 5,995,799 A * 11/1999 Nagashima et al. ..... 399/359
6,041,212 A * 3/2000 Okada ..... 399/359
2005/0002708 A1* 1/2005 Jeong et al. ..... 399/358
2005/0002709 A1* 1/2005 Jeong et al. ..... 399/358

FOREIGN PATENT DOCUMENTS

JP 11202708 A * 7/1999
JP 2001-92324 A 4/2001

* cited by examiner

*Primary Examiner*—David M. Gray
*Assistant Examiner*—Laura K Roth
(74) *Attorney, Agent, or Firm*—Foley & Lardner LLP

(57) ABSTRACT

An image forming apparatus of the present invention has a developer recycle apparatus. The developer recycle apparatus reuses a developer, which has been used once for a developer image formed on a surface of an image carrier and is recovered when the image carrier is subjected to cleaning. The developer recycle apparatus has a structure in which a toner dropping position is not vertically aligned with an axis of rotation of a carrying member which receives the dropped recycle toner, in a dropping/connecting portion in a carrying path for the recycle toner.

8 Claims, 5 Drawing Sheets

IMAGE FORMING APPARATUS, DEVELOPER RECYCLE APPARATUS AND DEVELOPER RECYCLE METHOD

BACKGROUND OF THE INVENTION

1. Field of the Invention

This invention relates to an image forming apparatus which forms an image by using a developer, and a developer recycle apparatus which returns a developer recovered from an image carrier to a developing device mounted on the image forming apparatus to recycle it as developer.

2. Description of the Related Art

Image forming apparatuses which form an image by using a developer containing, for example, toner, form an electrostatic latent image on a photosensitive drum as an image carrier, develop the electrostatic latent image by a developing device, transfer an obtained toner image to paper being a transferred material to which an image is transferred by a transfer device, and fix the image on the paper by a fixing device.

Among image forming apparatuses of this kind, known are apparatuses which remove toner remaining on the photosensitive drum by a drum cleaning device after the toner image is transferred to the paper, and returns the removed toner (hereinafter referred to as "recycle toner") to the developing device to recycle it. Further, known is a recycle toner carrying mechanism which carries the recycle toner received from the drum cleaning device to the developing device.

In this process, the drum cleaning device supplies the recycle toner to the recycle toner carrying mechanism without controlling the quantity of the recovered recycle toner. Therefore, there is a fear that the recycle toner adhering to the carrying path in the drum cleaning device comes off by vibration or the like, and that a large quantity of recycle toner is supplied to the recycle toner carrying mechanism at a time.

The large quantity of recycle toner supplied is jammed in a portion connecting the drum cleaning device and the recycle toner carrying mechanism, and causes a problem of blocking the carrying path of the recycle toner. Further, supplying a large quantity of recycle toner to the developing device at a time causes poor imaging (fog).

Further, unlike fresh toner, recycle toner has been subjected to mechanical, thermal and electric stress before being recovered by the drum cleaning device, and thus external additives of the surface of the recycle toner have been come off or buried in the recycle toner. Therefore, the recycle toner has moisture and viscosity, and has flowability much lower than that of fresh toner. This causes a problem that toner jams in the recycle toner carrying device and blocks the carrying path of the recycle toner.

As described above, if the carrying path of the recycle toner is blocked, there is the fear that the blockage is determined as occurrence of error and the apparatus is stopped. This causes the problem of decreasing the working efficiency of the user using the apparatus.

BRIEF SUMMARY OF THE INVENTION

According to an aspect of the present invention, there is provided an image forming apparatus comprising:

an image carrier which holds a developer image formed of a developer;

a developing device which provides the developer to the image carrier;

a transfer device which transfers the developer image held by the image carrier to a transfer member;

an image carrier cleaning mechanism including a cleaning member which removes the developer remaining on the image carrier from the image carrier, after the developer image is transferred from the image carrier to the transfer member, a first recycle developer carrying member which carries the removed developer in a first direction, and an opening provided on an extended line of the first direction; and a recycle developer carrying mechanism being connected with the image carrier cleaning mechanism in a position below the opening, and including a second recycle developer carrying member which carries, by rotation, the developer dropped from the opening to the developing device, wherein the second recycle developer carrying member is disposed in a direction orthogonal to the first direction, and has an axis of rotation which does not vertically aligned with a dropping position of the developer dropping from the opening.

According to another aspect of the present invention, there is provided a developer recycle apparatus comprising:

a cleaning member which removes a developer remaining on a surface of an image carrier from the image carrier, after a developer image formed of the developer provided from a developing device is transferred to a transferred material via the image carrier;

a first recycle developer carrying member which carries the developer removed from the image carrier by the cleaning member in a first direction; and a second recycle developer carrying member having an axis of rotation which is not vertically aligned with an opening, through which the developer carried by the first recycle developer carrying member drops, the opening being provided on an extended line of the first direction, the second recycle developer carrying member carrying the developer dropped from the opening and returning the developer to the developing device.

According to further another aspect of the present invention, there is provided a developer recycle method comprising:

removing a developer remaining on a surface of an image carrier from the image carrier by a cleaning member, after a developer image formed of the developer provided from a developing device is transferred to a transferred material via the image carrier;

carrying the developer, which has been removed from the image carrier by the cleaning member, to a dropping position by a first recycle developer carrying member; and carrying the developer dropped from the dropping position and returning the developer to the developing device, by a second recycle developer carrying member having an axis of rotation which is not vertically aligned with the dropping position of the developer carried and dropped by the first recycle developer carrying member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An example of an image forming apparatus to which an embodiment of the present invention is applied is explained with reference to drawings.

Figure 1:
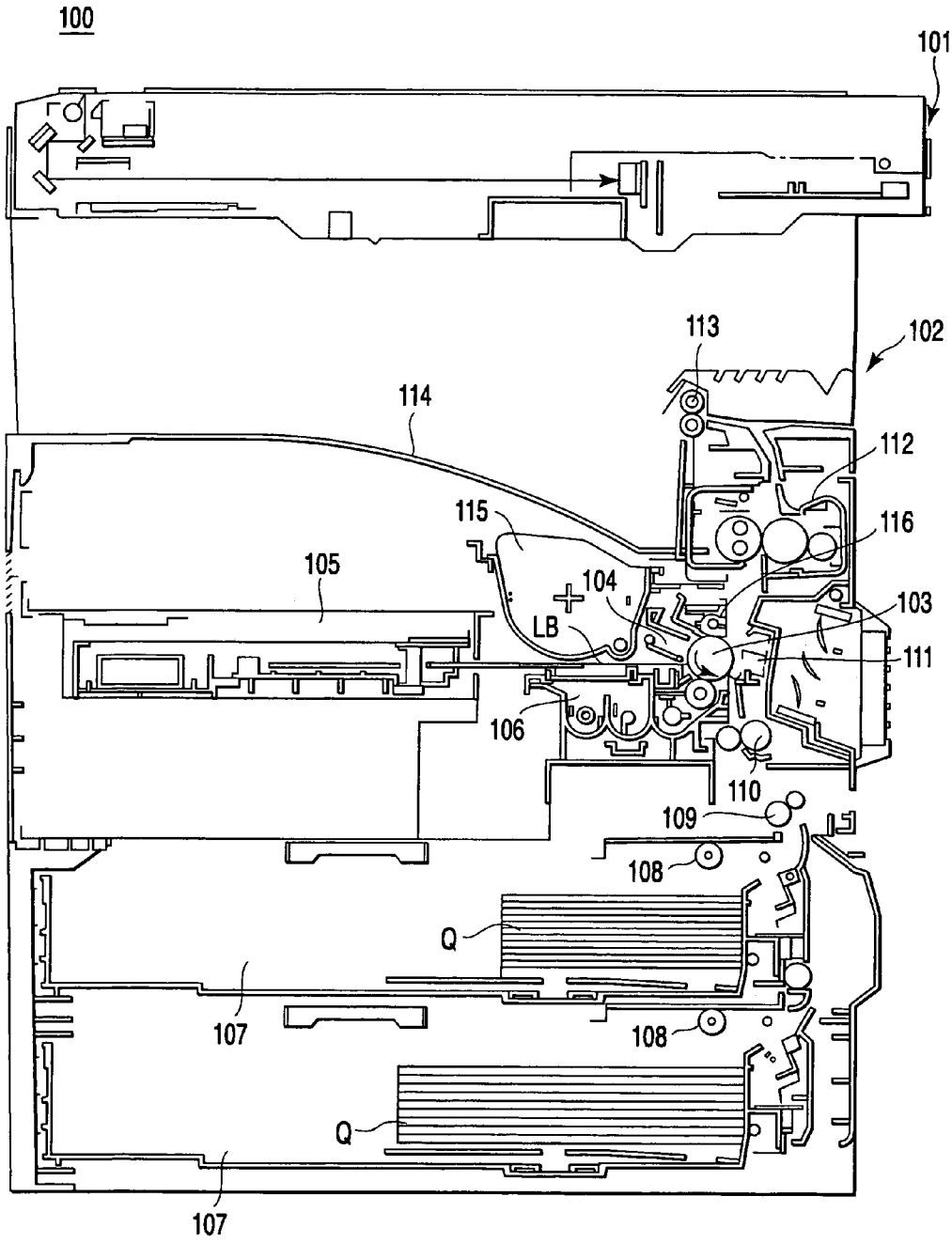
FIG. 1 is a schematic diagram illustrating an image forming apparatus to which an embodiment of the present invention is applicable.

FIG. 1 is a schematic diagram of an image forming apparatus with its cover removed, viewed from the front.

As shown in FIG. 1, an image forming apparatus (digital copying machine) 100 comprises an image reading device (scanner) 101 which reads an image of an object to be copied (original) and generates an image signal, and an image forming section 102 which forms an image on the basis of the image signal outputted from the scanner 101 or an image signal provided from the outside.

The image forming section 102 comprises a photosensitive drum (image carrier) 103, an electric charger 104, an exposure device 105, an developing device 106, paper cassettes 107, a pickup roller 108, a carrying roller 109, an aligning roller 110, a transfer device 111, a fixing device 112, a delivery roller 113, a delivery tray 114, a fresh toner replenishing device 115, and a drum cleaning mechanism (image-carrier cleaning mechanism) 116.

The photosensitive drum 103 has a photosensitive material on its external circumferential surface. If the material is irradiated with light in the state where a predetermined potential is applied to the material, the potential in the irradiated area changes, and the material can hold the change of the potential as an electrostatic image for a predetermined time.

The electric charger 104 charges the surface of the photosensitive drum 103 with a predetermined potential.

The exposure device 105 is disposed downstream from the electric charger 104 in the rotation direction of the photosensitive drum 103. The exposure device 105 exposes the photosensitive drum 103 to a laser beam LB, the light intensity of which is changed in response to an image signal supplied from the scanner 101. The laser beam LB can have a predetermined light intensity according to the density of the image, etc.

The developing device 106 is disposed downstream from the exposure device 105 in the rotation direction of the photosensitive drum 103. The developing device 106 stores a two-component developer comprising carrier and toner, and supplies toner (developer) to the surface of the photosensitive drum 103. This visualizes the latent image on the surface of the photosensitive drum 103, and a toner image (developer image) is formed.

Each of the paper cassettes 107 stores paper Q. The pickup roller 108 picks up paper Q one by one, and the paper Q is carried by the carrying roller 109 to the aligning roller 110.

The aligning roller 110 rotates at predetermined timing to align the paper Q with the toner image formed on the photosensitive drum 103 and carry the paper Q to a transfer position.

The transfer device 111 provides a predetermined potential to the paper Q, and transfers the toner image on the photosensitive drum 103 to the paper Q.

The fixing device 112 provides predetermined heat and pressure to the paper Q holding the toner image, and fixes the fused toner image onto the paper Q.

The delivery roller 113 carries the paper Q ejected from the fixing device 112 to the delivery tray 114.

The fresh toner replenishing device 115 supplies fresh toner which has never been used for image formation to the developing device 106 at predetermined timing.

The drum cleaning mechanism 116 is disposed downstream from the transfer position at which the photosensitive drum 103 is opposed to the transfer device 111, in the rotation direction of the photosensitive drum 103. The drum cleaning mechanism 116 removes toner and the like adhering to the surface of the photosensitive drum 103, and cleans the surface of the photosensitive drum 103.

Figure 2:
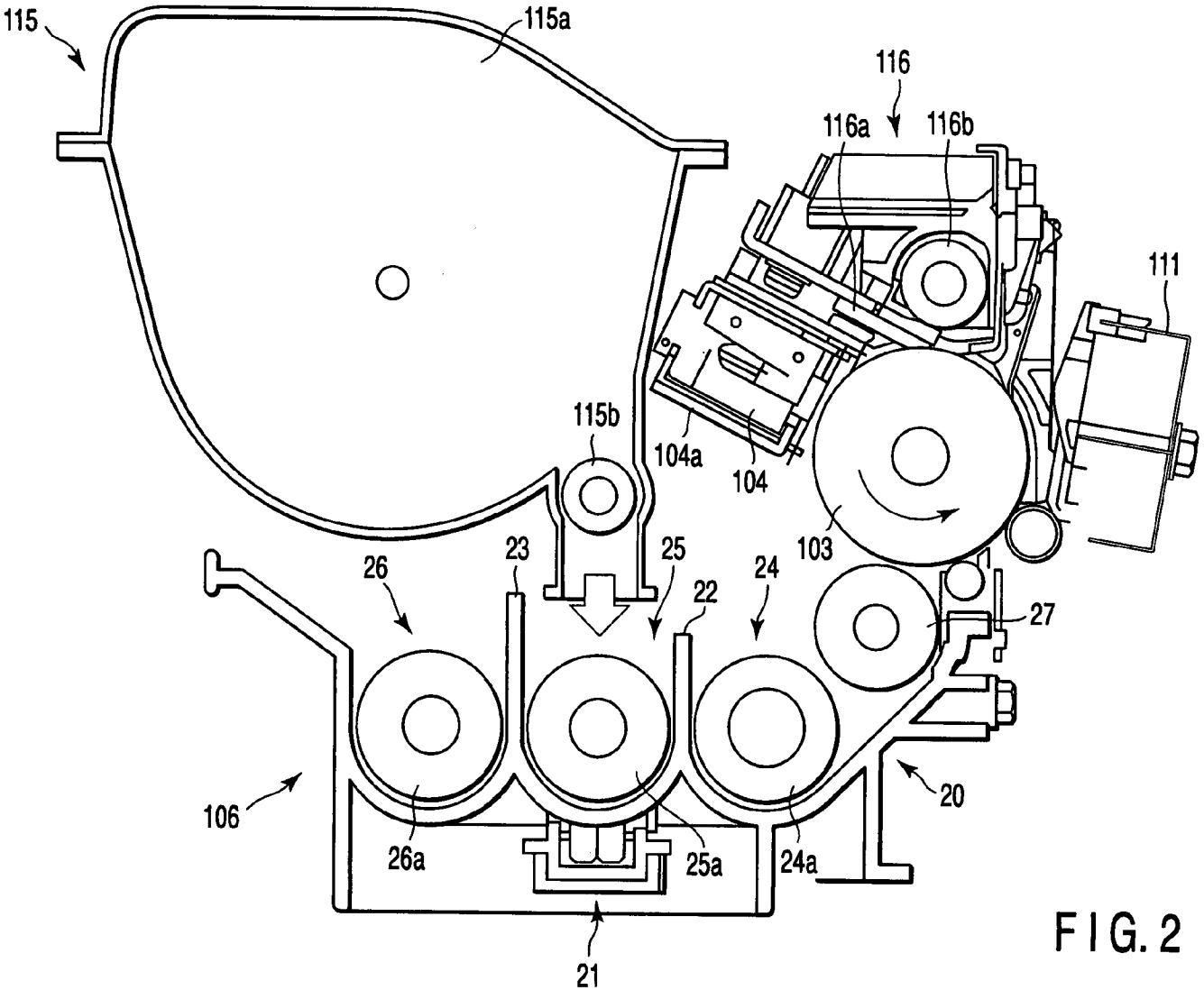
FIG. 2 is a cross-sectional view of a developing device mounted on the image forming apparatus shown in FIG. 1 and its surroundings.
Figure 3:
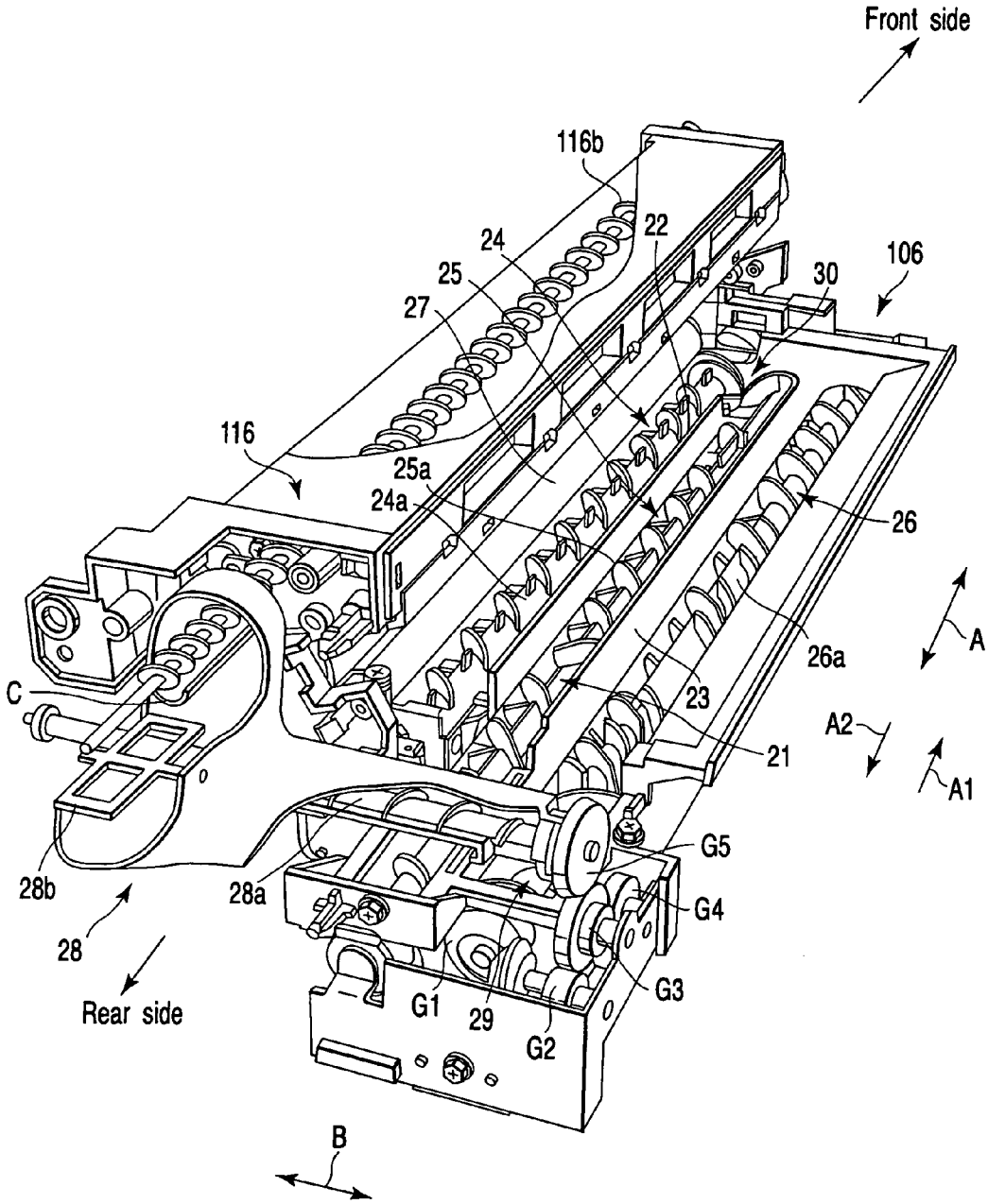
FIG. 3 is a schematic diagram of the developing device mounted in the image forming apparatus illustrated in FIG. 1 and its surroundings.

FIG. 2 is a schematic cross-sectional view of a front side of the developing device in the longitudinal direction. FIG. 3 is a schematic perspective view of the developing device and around.

As shown in FIG. 2, the developing device 106 has the fresh toner replenishing device 115, and is opposed to the photosensitive drum 103 at a predetermined position. Around the photosensitive drum 103, the electric charger 104 and a de-electrifying lamp 104*a* are arranged upstream from the developing position, where the drum 103 is opposed to the developing device 106, in the rotation direction. The transfer device 111 and the drum cleaning mechanism 116 are successively arranged downstream from the developing position in the rotation direction.

The fresh toner replenishing device 115 has a fresh toner cartridge 115*a* containing fresh toner, and a supplying roller 115*b* which is rotated by a fresh toner motor 57 (refer to FIG. 6) at predetermined timing and supplies the fresh toner to a predetermined position of the developing device 106.

The developing device 106 has a developing vessel 20 which stores the two-component developer (referred to as "developer" hereinafter) comprising carrier and toner, and a magnetic sensor 21 which detects the concentration of the toner in the developing vessel 20. The magnetic sensor 21 is preferably disposed below the developing vessel 20.

The developing vessel 20 is partitioned by a first partition 22 and a second partition 23 which have respective predetermined lengths in the axial direction of the photosensitive drum 103, into a first chamber 24, a second chamber 25 and a third chamber 26. The first partition 22 has such a predetermined length that the first chamber 24 and the second chamber 25 are connected to each other in each of the rear side and the front side, and the second partition 23 has such a predetermined length that the second chamber 25 and the third chamber 26 are connected to each other in each of the rear side and the front side (refer to FIG. 3).

The first chamber 24, the second chamber 25, and the third chamber 26 have a first mixer 24*a*, a second mixer 25*a* and a third mixer 26*a*, respectively. Each of the mixers has an axis parallel with an axial direction A (refer to FIG. 3) of the photosensitive drum 103. Further, in the first chamber 24, there is rotatably provided a developing roller 27 which is opposed to the surface of the photosensitive drum 103 at the developing position and supplies the developer (toner) thereto.

As shown in FIG. 3, the first mixer 24*a* is rotated to carry the developer in the first chamber 24 from the rear side to the front side, that is, in the direction of an arrow A1, while stirring the developer. The second mixer 25*a* is rotated to carry the developer in the second chamber 25 from the front side to the rear side, that is, in the direction of an arrow A2, while stirring the developer. The third mixer 26*a* is rotated to carry the developer in the third chamber 26 from the rear side to the front side, that is, in the direction of the arrow A1, while stirring the developer.

The drum cleaning mechanism 116 includes a cleaning member 116*a* (refer to FIG. 2) which removes toner (recycle toner, recycle developer) remaining on the surface of the photosensitive drum 103 having passed the transfer device 111, and a first recycle developer carrying member 116*b* which carries the removed toner to a dropping position C. Specifically, the first recycle developer carrying member 116*b* carries the recycle toner from the front side to the rear side, and the carried recycle toner is gathered into the dropping position C. The recycle toner which has reached the dropping position C drops into a portion connected to a recycle developer carrying mechanism 28 mounted on the rear side of the developing device 106.

The recycle developer carrying mechanism 28 is connected, around the dropping position C, with a carrying path for the recycle toner from the drum cleaning mechanism 116, and carries the recycle toner which has dropped from the drum cleaning mechanism 116 to a recycle toner supplying portion 29 of the third chamber 26, which is a supplying position of the developing device 106.

The recycle developer carrying mechanism 28 has, for example, an axis of a direction B orthogonal to the axial direction A of the photosensitive drum 103. The recycle developer carrying mechanism 28 has a second recycle developer carrying member 28*a* which is a mixer having a spiral blade and can carry the recycle toner by rotary movement, and a paddle 28*b* which passes the recycle toner having dropped from the drum cleaning mechanism 116 to the second recycle developer carrying member 28*a*. The developer recycle apparatus includes the above drum cleaning mechanism 116 and the recycle developer carrying mechanism 28.

Further, a fresh toner supplying portion 30, to which fresh toner from the fresh toner replenishing device 115 is supplied, is disposed on the front side of the second chamber 25, that is, the side opposite, in the axial direction A of the photosensitive drum 103, to the rear side on which the recycle toner supplying portion 29 is disposed.

Therefore, the third mixer 26*a* carries the recycle toner received from the recycle developer carrying mechanism 28 and the developer received from the second mixer 25*a* from the rear side to the front side, while stirring them, and passes them again to the second mixer 25*a* on the front side. The second mixer 25*a* carries the developer received from the third mixer 26*a* and the first mixer 24*a* and the fresh toner received from the fresh toner replenishing device 115 on the front side from the front side to the rear side, while stirring them, and passes them to the first mixer 24*a* and the third mixer 26*a* on the rear side. The first mixer 24*a* carries the developer received from the second mixer 25*a* on the rear side from the rear side to the front side, while stirring the developer, and simultaneously supplies the developer to the developing roller 27.

Figure 6:
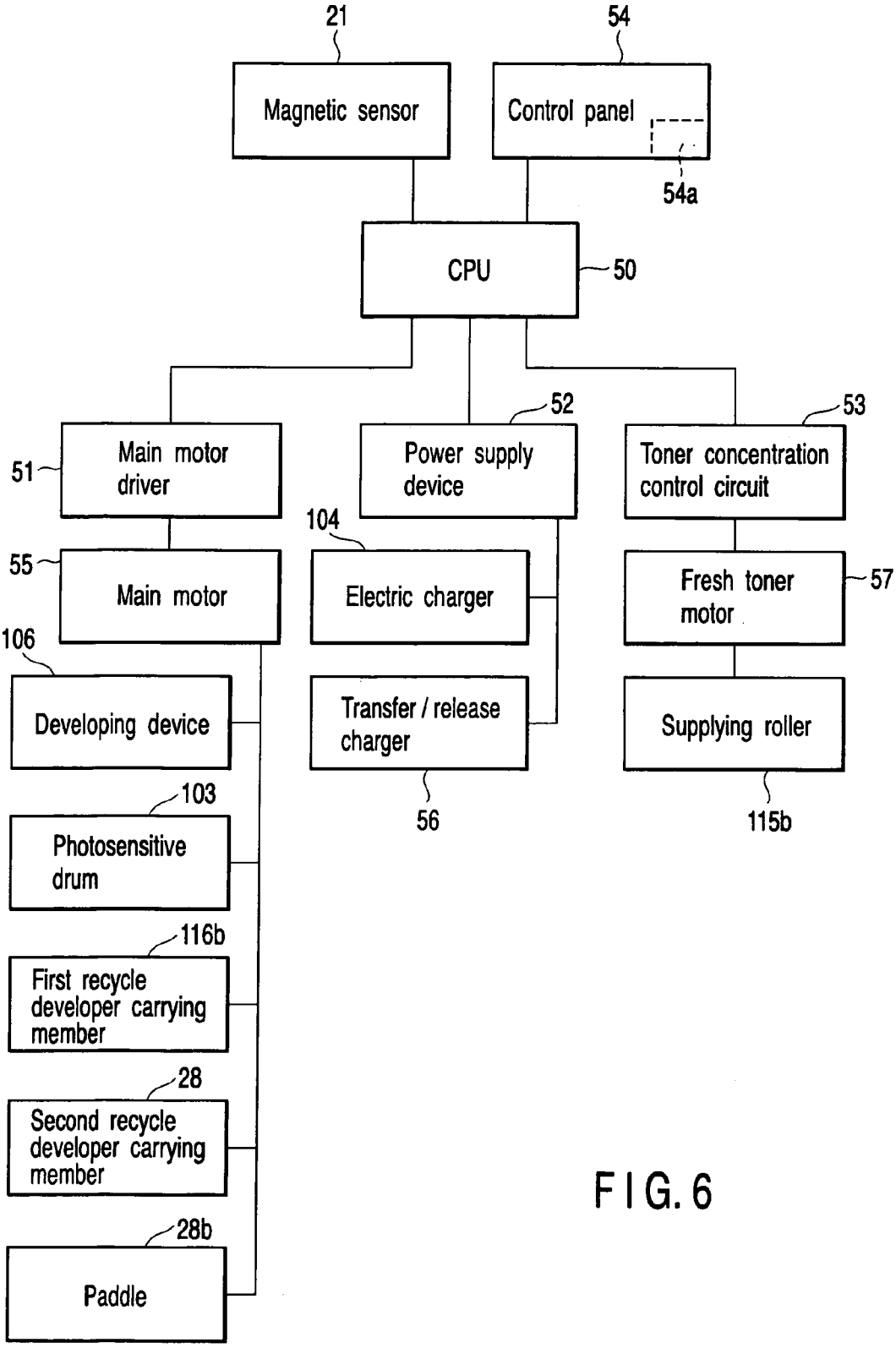
FIG. 6 is a block diagram illustrating a control system of an image forming section shown in FIG. 1.

The recycle developer carrying mechanism 28 interlocks with a gear G1 connected to the rear side of the central shaft of the third mixer 26*a*, and a gear G5 connected to one end of the central shaft via gears G2, G3 and G4 engaged with the gear G1, and can be rotated by rotating force from a main motor 55 (refer to FIG. 6). Further, the rotating force is conveyed to the photosensitive drum 103, the first recycle developer carrying member 116*b*, the first to third mixers 24*a* to 26*a*, the second recycle developer carrying member 28*a*, and the paddle 28*b* via the gears G2, G3 and G4.

Therefore, the photosensitive drum 103, the first to third mixers 24*a* to 26*a*, the first recycle developer carrying member 116*b*, the second recycle developer carrying member 28*a*, and the paddle 28*b* can be rotated simultaneously with rotation of the main motor 55. If it is required to set the numbers of revolutions of the first recycle developer carrying member 116*b*, the second recycle developer carrying member 28*a* and the paddle 28*b* to different numbers, the circumferences of the engaged gears are adjusted, or they can further include respective motor drivers and motors which are independently connected to a CPU 50 (refer to FIG. 6).

Figure 4:
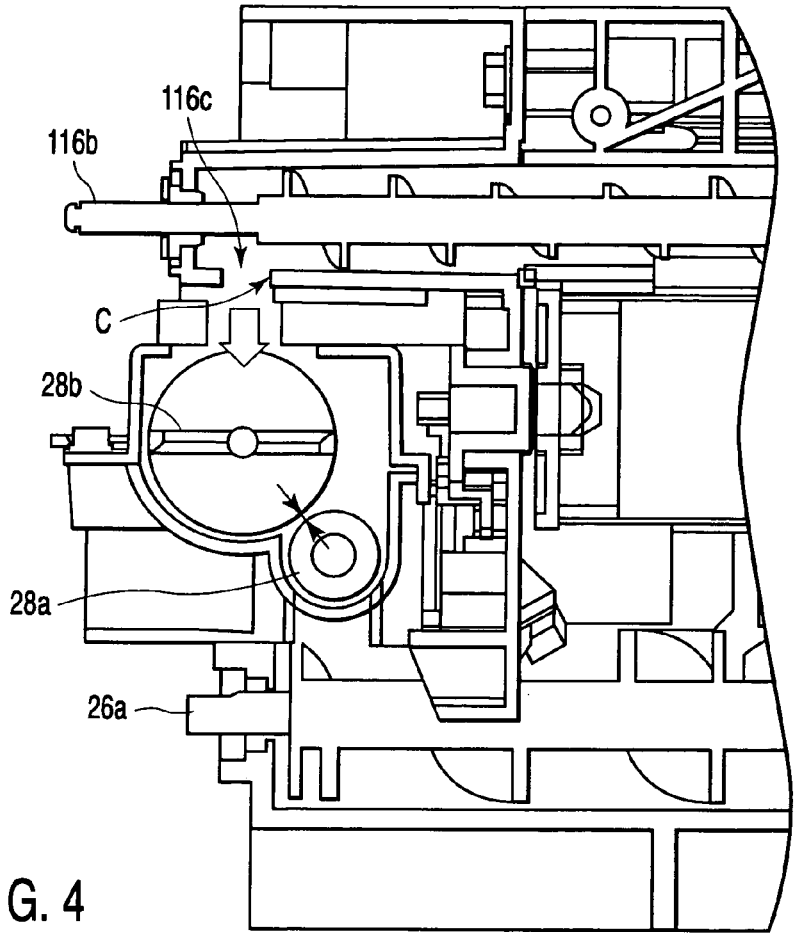
FIG. 4 is a cross-sectional view of a connecting portion between the developing device and a developer recycle apparatus which are mounted on the image forming apparatus shown in FIG. 1.
Figure 5:
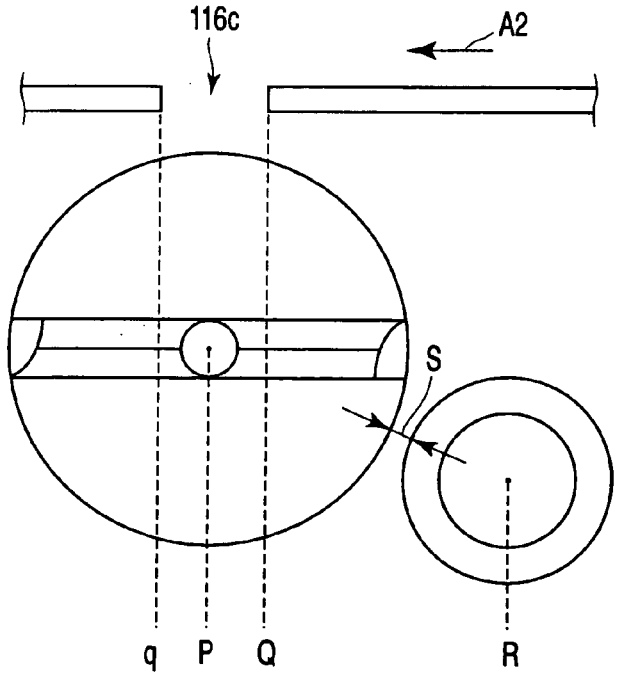
FIG. 5 is a cross-sectional view for further detailed explanation of the connection portion shown in FIG. 4.

Next, with reference to FIGS. 4 and 5, the connecting portion between the drum cleaning mechanism 116 and the recycle developer carrying mechanism 28 is explained in more detail. FIG. 4 is a cross-sectional view of a connecting portion among the drum cleaning mechanism 116, the recycle developer carrying mechanism 28, and the developing device 106 shown in FIG. 3, as viewed from the right side of FIG. 3.

As shown in FIG. 4, the recycle developer carrying mechanism 28 has the paddle 28*b* between the first recycle developer carrying member 116*b* and the second recycle developer carrying member 28*a*.

The paddle 28*b* loosens the recycle toner dropping from the drum cleaning mechanism 116, and can supply the toner by predetermined quantities to the second recycle developer carrying member 28*a*. This prevents supply of a large amount of toner to the second recycle developer carrying member 28*a* at a time, and prevents the toner from being jammed in the carrying path for the recycle toner, and the carrying path from being blocked.

As shown in FIG. 5, the center of rotation R of the second recycle developer carrying member 28*a* does not aligned, in the vertical direction, with the range defined by dotted lines Q-q which corresponds to the dropping position C in the drum cleaning mechanism 116. Specifically, the center of rotation R does not fall within the range of the dotted lines Q-q. Further, the center of rotation of the second recycle developer carrying member 28*a* and the dropping position C, that is, the dotted line R and the dotted line Q are preferably separate from each other by at least a predetermined distance.

The dropping position C is a position where the recycle toner, which has been carried by the first recycle developer carrying member 116*b* through the drum cleaning mechanism 116 in the direction of the arrow A2, drops from the edge of a dropping opening 116*c* provided in the housing of the drum cleaning mechanism 116. In this embodiment, suppose that the recycle toner vertically drops as shown by the dotted line Q. If a large quantity of recycle toner drops at a time, the dropping position exists within the range of the width Q-q of the dropping opening 116*c* of the housing. Therefore, in this embodiment, the dropping position falls within the range defined by the dotted lines Q-q, including the dotted line Q.

Further, the center of rotation R of the second recycle developer carrying member 28*a* is not aligned with the center of rotation P of the paddle 28*b* in the vertical direction. The center of rotation P of the paddle 28*b* falls within the range of the width Q-q of the dropping opening 116*c* of the housing of the drum cleaning mechanism 116.

By adopting this structure, even if a large quantity of recycle toner drops from the dropping position C at a time, the recycle toner is loosened by the paddle 28*b* and supplied to the second recycle developer carrying member 28*a* by predetermined quantities. This prevents dropping of a large quantity of recycle toner to the second recycle developer carrying member 28*a* at a time, and jamming of the toner in the second recycle developing carrying member 28*a*.

Further, the space S between the paddle 28*b* and the second recycle developer carrying member 28*a* is set to 1 mm or less. This inhibits accumulation of the recycle toner between the paddle 28*b* and the second recycle developer carrying member 28*a*, and thus there is no fear of blocking the carrying path of the recycle toner.

Next, explained is the developer carrying quantities of the first recycle developer carrying member 116*b*, the second recycle developer carrying member 28*a*, and the paddle 28*b*.

As shown in FIG. 3, the first recycle developer carrying member 116*b* and the second recycle developer carrying member 28*a* are mixers wherein a spiral blade is formed on a shaft, and the developer quantity which can be carried per unit time can be adjusted according to the number of rotation of the shaft and the area of the blade, etc. Further, as shown in FIG. 3, the paddle 28*b* has two blades each having a hole in the center, and has a structure wherein the developer quantity which can be carried per unit time can be adjusted by changing the area and the number of rotation of the blade.

The developer quantity which can be carried (hereinafter referred to as "developer carrying quantity") is adjusted as described above. A plurality of members in the carrying path of the recycle toner are configured to increase the developer carrying quantity gradually from the downstream side to the upstream side of the developer carrying direction. Specifically, the developer carrying quantity of the paddle 28*b* is set to be greater than the developer carrying quantity of the first recycle developer carrying member 116*b*, and the developer carrying quantity of the second recycle developer carrying member 28*a* is set to be greater than that of the paddle 28*b*. Thereby, the recycle toner is carried smoothly. Further, even if a large quantity of recycle toner drops from the dropping position C at a time, the developer is successively carried from the head (the upstream side in the carrying direction), and thus toner jamming due to blocking of the carrying path by the recycle toner is prevented.

FIG. 6 is a block diagram illustrating a control system of the image forming section 102 shown in FIG. 1.

As shown in FIG. 6, the CPU 50 is connected to a main motor driver 51, a power supply device 52, a toner concentration control circuit 53, a control panel 54 and a magnetic sensor 21.

The control panel 54 includes a display section 54*a*. To the control panel 54, the user inputs an instruction of a predetermined operation, for example, an instruction for image reading by the scanner 101, an instruction for image formation by the image forming section 102, and both instructions for image reading and image formation.

The magnetic sensor 21 detects the ratio of the carrier (for example, iron or ferrite) to the toner (for example, resin), which are contained in the developing vessel 20 of the developing device 106, as the toner concentration, and outputs a detected value to the CPU 50. The CPU 50 compares the detected value of the toner concentration inputted from the magnetic sensor 21 with a predetermined reference value and, if the detected value is lower than the reference value, outputs a toner replenishing signal to the toner concentration control circuit 53. In more detail, the CPU 50 outputs a toner replenishing signal to the toner concentration control circuit 53, such that the toner is replenished for a predetermined time, according to the level of the output voltage inputted from the magnetic sensor 21 as the toner concentration.

The main motor driver 51 is connected to the main motor 55, and outputs a drive signal when it receives an instruction for image formation from the control panel 54.

The main motor 55 is connected to the first to third mixers 24*a* to 26*a* and the developing roller 27 of the developing device 106, the photosensitive drum 103, the first recycle developer carrying member 116*b*, the second recycle developer carrying member 28*a* and the paddle 28*b*, or interlocks with them via gears G1 to G5. When a drive signal is inputted from the main motor driver 51, the main motor 55 provides a predetermined drive force to them.

The power supply device 52 is connected to the electric charger 104 and a transfer/release charger 56. When it receives an instruction for image reading from the control panel 54, the power supply device 52 outputs a predetermined voltage after a predetermined time or immediately.

The electric charger 104 is supplied with the predetermined voltage from the power supply device 52, and thereby discharges electricity to provide a predetermined charge to the surface of the photosensitive drum 103.

The toner concentration control circuit 53 is connected to the fresh toner motor 57. When a toner replenishing signal is inputted from the CPU 50, the fresh toner motor 57 operates for a predetermined time.

The fresh toner motor 57 replenishes fresh toner of a predetermined quantity to the fresh toner supplying portion 30 via the supplying roller 115*b* which is operated by the toner concentration control circuit 53.

Next, an operation method of the image forming apparatus 100 is explained. In this embodiment, image formation using a reversal process is explained.

For example, when the control panel 54 issues instructions for both image reading and image formation, the scanner 101 starts image reading, and the image forming section 102 outputs a predetermined voltage from the power supply device 52 to cause the electric charger 104 to discharge electricity. Further, since image formation is instructed simultaneously, the main motor driver 51 outputs a drive signal to the main motor 55.

The scanner 101 includes a light source, a lens, and a charge-coupled device (CCD). The scanner 101 forms an image of light reflected from an object to be copied on a light-receiving surface of the CCD by using the lens, and obtains an image signal from the reflected light which has been subjected to optoelectronic conversion by the CCD. The obtained image signal is outputted to the exposure device 105, and converted into a laser beam LB having a predetermined light intensity.

The laser beam LB is applied to the surface of the photosensitive drum 103 which has been negatively charged uniformly by the electric charger 104, and the potential of the area of the surface to which the laser beam LB has been applied approaches zero. Specifically, a latent image is formed on the surface of the photosensitive drum 103.

The toner which has been negatively charged by the developing device 106 is attracted to the latent image portion on the surface of the photosensitive drum 103 irradiated with the laser beam LB and having a predetermined potential level, and thereby a toner image is formed.

The toner image is carried to a transfer position by the aligning roller 110, and moved onto the paper Q positively charged by the transfer device 111.

The toner image transferred onto the paper Q is fused and fixed thereon by the fixing device 112. Specifically, the image is formed on the paper Q.

The paper Q on which the image is formed by the fixing device 112 is ejected to the delivery tray 114 by the delivery roller 113.

In the meantime, the toner which was not transferred from the surface of the photosensitive drum 103 to the paper Q and has reached the drum cleaning mechanism 116 is removed from the photosensitive drum 103 by the cleaning member 116*a*, and recovered and collected into the housing of the drum cleaning mechanism 116. The recovered recycle toner is carried to the rear side by the first recycle developer carrying member 116*b*, and collected into the dropping position C.

The recycle toner which has dropped from the dropping position C is loosened by the paddle 28*b*, and passed to the second recycle developer carrying member 28*a* by predetermined quantities. The second recycle developer carrying member 28*a* carries the recycle toner received from the paddle 28*b* to the recycle toner supplying section 29 which is a supplying position to the developing vessel 20. The recycle toner which has been supplied from the recycle toner supplying section 29 to the developing vessel 20 is mixed with fresh toner replenished from the fresh toner supplying device 115, and reused as developer. If the magnetic sensor 21 senses a decrease in the toner concentration in the developing vessel 20, the toner concentration control circuit 53 drives the fresh toner motor 57 only for a predetermined time (predetermined number of revolutions), and thereby fresh toner is supplied to the fresh toner supplying section 30.

Further, if the toner concentration detected by the magnetic sensor 21 does not increase even through the supplying roller 115*b* is operated by outputting a drive signal from the toner concentration control circuit 53 for a predetermined time, the apparatus displays on the display section 54*a* that the fresh toner in the fresh toner cartridge 115*a* has been exhausted, and notifies the user of toner exhaustion.

As described above, the present invention can prevent the recycle toner recovered from the photosensitive drum 103 from being supplied to the developing device 106 in a large amount at a time, and prevents toner jamming in the carrying path from the photosensitive drum 103 to the developing device 106. Therefore, the image forming apparatus of the present invention can form a stable image.

What is claimed is:

1. An image forming apparatus, comprising:

an image carrier which has an axis and holds a developer image formed of a developer;

a developing device which provides the developer to the image carrier;

a transfer device which transfers the developer image held by the image carrier to a transfer member;

an image carrier cleaning mechanism including a cleaning member which removes the developer remaining on the image carrier from the image carrier, after the developer image is transferred from the image carrier to the transfer member; and a recycle developer carrying mechanism which is connected with the image carrier cleaning mechanism and carries the developer, removed from the image carrier by the image carrier cleaning mechanism, to the developing device, the recycle developer carrying mechanism including:

a first recycle developer carrying member which is convoluted and carries the removed developer in a first direction in parallel to the axis of the image carrier;

an opening provided on an extended line of the first direction which ejects the developer carried in the first direction by the first recycle developer carrying member to a recycle developer carrying mechanism;

a second recycle developer carrying member which is arranged in a position below the opening, and is convoluted and carries, by rotation, the developer dropped from the opening to the developing device, the second recycle developer carrying member being arranged perpendicular to the first direction and having an axis of rotation that is not aligned in a vertical direction with a position at which the developer drops from the opening; and a paddle which is arranged in a position below the opening and between the opening and the second recycle developer carrying member and which loosens and carries, by rotation, the developer dropped from the opening to the second recycle developer carrying member, the paddle having an axis of rotation that is perpendicular to the axis of the image carrier is aligned in a vertical direction with the opening and is not vertically aligned with the axis of rotation of the second recycle developer carrying member.

2. An image forming apparatus according to claim 1, wherein a space between the second recycle developer carrying member and the paddle is 1.0 mm or less.

3. An image forming apparatus according to claim 1, wherein a developer carrying quantity of the paddle is greater than a developer carrying quantity of the first recycle developer carrying member.

4. A developer recycle apparatus, comprising:

a cleaning member which removes a developer remaining on a surface of an image carrier from the image carrier, after a developer image formed of the developer provided from a developing device is transferred to a transferred material via the image carrier;

a first recycle developer carrying member which is convoluted and carries the developer removed from the image carrier by the cleaning member in a first direction in parallel to an axis of the image carrier;

an opening, disposed on a lower portion of the first recycle developer carrying member, which ejects the developer carried in the first direction by the first recycle developer carrying member;

a second recycle developer carrying member which is arranged in a position below the opening and is convoluted and carries, by rotation, the developer dropped from the opening, the second recycle developer carrying member being arranged perpendicular to the first direction and having an axis of rotation which is not aligned in a vertical direction with a position at which the developer drops from the opening; and a paddle which is arranged in a position below the opening and between the opening and the second recycle developer carrying member and which loosens and carries, by rotation, the developer dropped from the opening to the second recycle developer carrying member, the paddle having an axis of rotation that is perpendicular to the axis of the image carrier is aligned in a vertical direction with the opening and is not vertically aligned with the axis of rotation of the second recycle developer carrying member.

5. A developer recycle apparatus according to claim 4, wherein a space between the second recycle developer carrying member and the paddle is 1.0 mm or less.

6. A developer recycle apparatus according to claim 4, wherein a developer carrying quantity of the paddle is greater than a developer carrying quantity of the first recycle developer carrying member.

7. A developer recycle apparatus according to claim 4, wherein a developer carrying quantity of the second recycle developer carrying member is greater than the developer carrying quantity of the paddle.

8. A developer recycle method, comprising:

removing a developer remaining on a surface of an image carrier from the image carrier by a cleaning member, after a developer image formed of the developer provided from a developing device is transferred to a transferred material via the image carrier;

carrying the developer, which has been removed from the image carrier by the cleaning member, to a dropping position by a first recycle developer carrying member in a first direction in parallel to an axis of the image carrier; and carrying the developer dropped from the dropping position and returning the developer to the developing device, by a second recycle developer carrying member which is convoluted, arranged perpendicular to the first direction, and has an axis of rotation which is not aligned in a vertical direction with a position from which the developer drops from the dropping position; and loosening and carrying the developer dropped from the dropping position to the second recycle developer carrying member, by a paddle which is arranged in a position below the opening and between the opening and the second recycle developer carrying member, the paddle having an axis of rotation that is perpendicular to the axis of the image carrier is aligned in a vertical direction with the opening and is not vertically aligned with the axis of rotation of the second recycle developer carrying member.

* * * * *